United States Patent [19]

Watanabe et al.

[11] Patent Number: 4,633,667

[45] Date of Patent: Jan. 6, 1987

[54] BURNER FOR STIRLING ENGINES

[75] Inventors: Tetsumi Watanabe, Okazaki; Akira Yamaguro, Chiryu, both of Japan

[73] Assignee: Aisin Seiki Kabushiki Kaisha, Aichi, Japan

[21] Appl. No.: 838,351

[22] Filed: Mar. 11, 1986

[30] Foreign Application Priority Data

Mar. 20, 1985 [JP] Japan ..... 60-40304[U]

[51] Int. Cl.[4] ..... F02G 1/04

[52] U.S. Cl. ..... 60/517; 431/188

[58] Field of Search ..... 60/517; 431/183, 187, 431/188

[56] References Cited

U.S. PATENT DOCUMENTS

| | | | |
|---|---|---|---|
| 2,458,543 | 1/1949 | Urquhart | 431/188 X |
| 4,004,875 | 1/1977 | Zink et al. | 431/187 X |
| 4,105,395 | 8/1978 | Goodnight et al. | 431/187 X |

FOREIGN PATENT DOCUMENTS

| | | | |
|---|---|---|---|
| 58-124046 | 7/1983 | Japan | 60/517 |

*Primary Examiner*—Allen M. Ostrager

*Attorney, Agent, or Firm*—Burns, Doane, Swecker & Mathis

[57] ABSTRACT

A burner for a Stirling engine includes a baffle for partitioning the interior of a housing into an air chamber and a combustion chamber, the baffle having a centrally located cylindrical portion of tapered configuration, and a generally cylindrical ceramic burner cone for primary combustion of an air-fuel mixture, the burner cone being inserted into and retained by the cylindrical portion of the baffle and having a tapered outer circumferential surface and an annular end face on an upstream side thereof. The baffle is equipped with an engagement portion having an annular outer circumferential surface for engaging the annular end face of the burner cone. The burner cone is retained by the tapered cylindrical portion of the baffle and the engagement portion. If the burner is used in the horizontal attitude, the weight of the burner cone is supported by the engagement portion and tapered cylindrical portion of the baffle, so that the burner cone can be reliably retained without tilting even if the baffle expands owing to the heat of combustion.

3 Claims, 5 Drawing Figures

BURNER FOR STIRLING ENGINES

BACKGROUND OF THE INVENTION

1. Field of the Invention:

This invention relates to a burner used in a Stirling engine and, more particularly, to a burner improved to retain a burner cone more reliably.

2. Description of the Prior Art:

A conventional burner for a Stirling engine includes a ceramic burner cone having a tapered outer circumferential surface, and a metal baffle having a cylindrical portion defining a tapered cavity into which the burner cone is inserted for being supported by the baffle. When the burner is installed in the engine in a horizontal attitude, the temperature of the baffle rises substantially, as a result of which the inner diameter of the cylindrical portion increases owing to thermal expansion. Since the ceramic burner cone undergoes less expansion at such time, a gap forms between the cylindrical portion and the burner cone, which is thus allowed to tilt with respect to the central axis of a swirler. Since the flame produced by the tilted burner cone will also be tilted, uneven heating of the engine heater tubes will result.

Another problem ascribable to the tilted burner cone is encountered when the flame is extinguished at engine shut-down. Specifically, since the baffle contracts at such time owing to a drop in temperature, the burner cone is subjected to stress that can cause it damage. Further, since the burner cone has little electrical conductivity owing to its ceramic construction, it cannot be used as the ground electrode of the burner igniter.

SUMMARY OF THE INVENTION

An object of the present invention is to provide a burner for a Stirling engine devoid of the aforementioned problems encountered in the prior art.

Another object of the present invention is to provide a burner for a Stirling engine, which burner enables a burner cone to be reliably retained even when the burner is used in a horizontal attitude, while at the same time allowing the burner cone to be readily mounted and protected against damage.

According to the present invention, the foregoing objects are attained by providing a burner for a Stirling engine, comprising a housing; a baffle for partitioning the interior of the housing into an air chamber and a combustion chamber, the baffle having an outer circumferential portion supported on the housing and a centrally located cylindrical portion of tapered configuration; a generally cylindrical ceramic burner cone for primary combustion of a mixture of fuel and combustion air, the burner cone being inserted into and retained by the cylindrical portion of the baffle and having a tapered outer circumferential surface and an annular end face on an upstream side thereof; a plurality of heater tubes supported on the housing and arranged on an inner circumferential side of the combustion chamber; and a fuel injector nozzle supported on the housing for injecting fuel into the burner cone at an upstream portion thereof. The baffle is equipped with an engagement portion having an annular outer circumferential surface for engaging the annular end face of the burner cone. The burner cone is retained by the tapered cylindrical portion of the baffle and the engagement portion.

A baffle which is basically similar to that employed in the prior art can be used. The tapered cylindrical portion of the baffle at the central portion where the plate divides the housing into the air and combustion chambers presents its wider opening to the air chamber and its smaller opening to the combustion chamber. The baffle is shielded from heat by the burner cone and therefore is not exposed to extremely high temperatures. Accordingly, the baffle ordinarily is made of a metal which can be readily worked.

The burner cone is cylindrical in shape and serves to ignite the fuel and subject the fuel to primary combustion within the cone and then deliver the flame to the combustion chamber. Accordingly, it is preferred to make use of a ceramic having excellent resistance to heat, an example of which is a silicon nitride ceramic. The outer circumferential portion of the burner cone has a tapered configuration generally matching the shape of the cylindrical portion of the baffle. The burner cone can be retained by inserting it into the cylindrical portion of the baffle from the air chamber side.

The combustion chamber is provided with a plurality of heater tubes, just as in the prior-art arrangement. These heater tubes communicate with the working space of the Stirling engine and have a working gas such as helium or hydrogen sealed therein. The heat from combustion of the fuel heats the working gas via the heater tubes, thereby making it possible to drive the Stirling engine.

The fuel injector nozzle, which injects a fuel such as city gas into an upstream portion of the burner cone, can be the same as that used in the prior-art burner.

The chief characterizing feature of the present invention resides in the engagement portion provided on the baffle on the upstream side of the burner cone, the engagement portion having an annular outer circumferential surface for engaging the annular end face of the burner cone on its upstream side. Various configurations can be selected for this engagement portion. For example, the engagement portion can be inserted into the opening of the burner cone on its upstream side so that its annular outer circumferential surface engages the burner cone in a direction perpendicular to the direction of the central axis of of the cone.

Further, the engagement portion can be provided with the annular groove by forming the baffle to include a rim portion which projects toward the burner cone, the groove being formed between the engagement portion as the rim. The annular projection provided on the upstream side face of the burner cone is mated with the annular groove when the burner cone is installed.

If the burner in accordance with the present invention is used in the horizontal attitude, the weight of the burner cone is supported by the engagement portion and tapered cylindrical portion of the baffle, so that the burner cone can be reliably retained without tilting even if the baffle expands owing to the heat of combustion. Here a portion of the air introducing swirler, e.g., a metal flange for supporting the swirler, can be made to serve as a portion of the baffle, and the engagement portion can be provided on the metal flange. When the burner is used in the vertical attitude, the burner cone can be reliably retained mainly by the tapered cylindrical portion of the baffle even at the time of heating. Though the burner cone can be secured by bolts, there are cases where the bolts break owing to the local application of internal thermal stress to the bolt holes when the burner cone is subjected to high temperatures. Accordingly, the burner cone preferably has a simple shape. This requirement is also satisfied by the present invention.

When the burner of the present invention is used in the horizontal attitude, the engagement portion provided on the baffle bears the weight of the burner cone that acts in a direction perpendicular to the central axis of the burner cone, thus enabling the burner cone to be retained. In addition, the burner cone can be reliably retained without tilting even if the heat produced by combusting the fuel causes the cylindrical portion of the baffle to expand, with an accompanying increase in its inner diameter. If the burner is used in the vertical attitude, deformation due to thermal expansion is absorbed by the tapered cylindrical portion of the baffle, just as in the prior art, so that the burner cone can be reliably retained.

Furthermore, when fuel is combusted in the burner, the engagement portion expands diametrically owing to the combustion heat and thus draws closer to the end face of the burner cone that opposes the engagement portion. This causes the burner cone to be retained even more positively.

Other features and advantages of the present invention will be apparent from the following description taken in conjunction with the accompanying drawings, in which like reference characters designate the same or similar parts throughout the figures thereof.

FURTHER DESCRIPTION OF THE PRIOR ART

Figure 1:
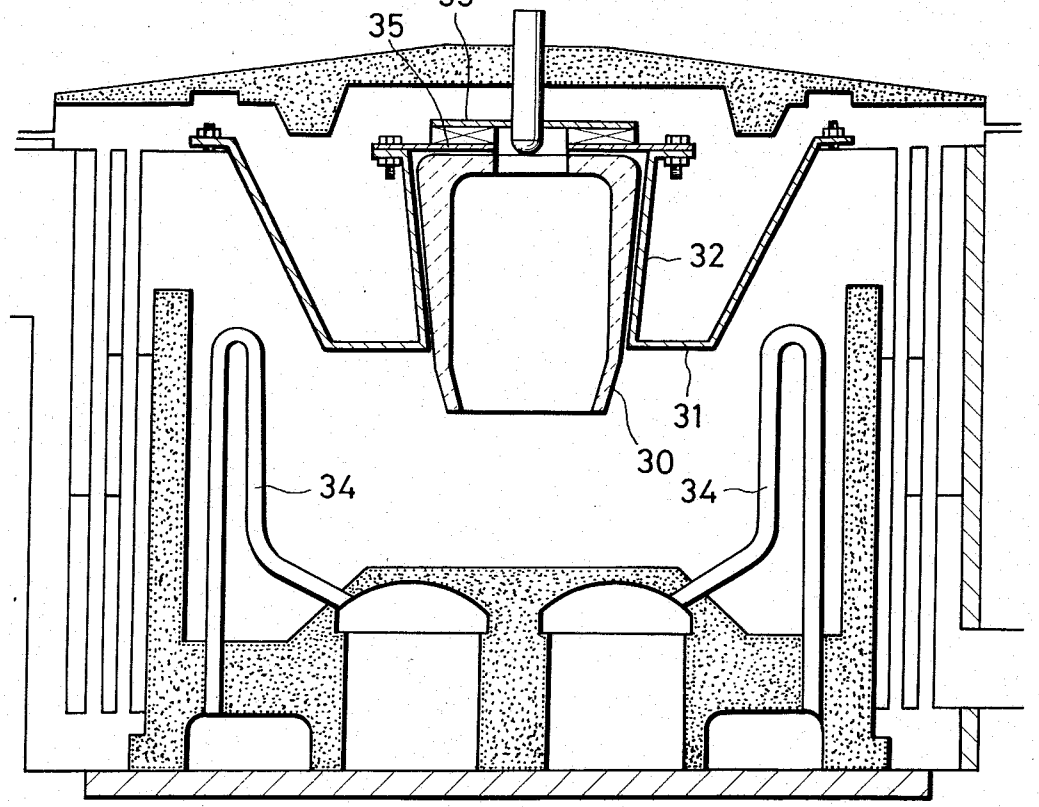
FIG. 1 PRIOR ART
FIG. 1 is a schematic sectional view showing the entirety of a prior-art burner for a Stirling engine.
Figure 2:
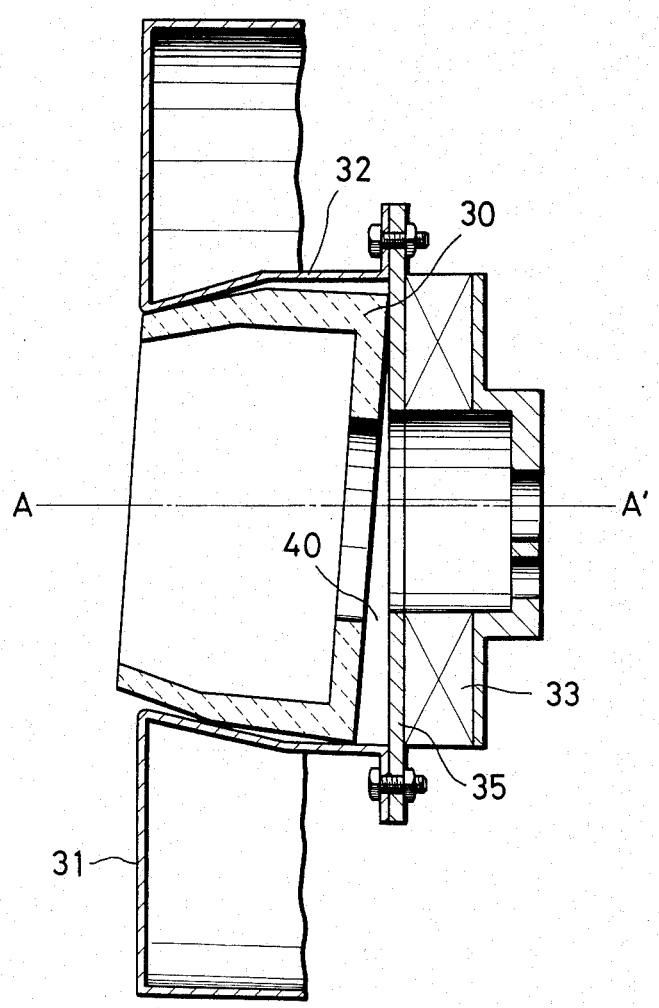
FIG. 2 PRIOR ART
FIG. 2 is an enlarged sectional view illustrating a principal portion of the burner of FIG. 1, in which a burner cone is here shown to be in an inclined attitude with respect to the horizontal.

Before describing an embodiment of the present invention in detail, let us refer to FIGS. 1 and 2 for a more detailed review of the prior art and the problems encountered therein.

A known example of a burner for a Stirling engine, such as illustrated in FIG. 1, is disclosed in the specification of Japanese Patent Application Laid-Open No. 58-106542. This prior-art burner includes a ceramic burner cone 30 having a tapered outer circumferential surface, and a metal baffle 31 defining a cylindrical portion 32 which delimits a tapered cavity into which the burner cone 30 is inserted for being supported by the baffle 31. Accordingly, if a difference in thermal expansion should occur between the burner cone 30 and the baffle 31, any deformation attributable to thermal expansion can be absorbed by the tapered surface. As a result, the burner cone 30 is not subjected to stress and will not be damaged. Mounting and dismounting of the burner cone 30 is accomplished very easily since the cone is merely inserted into or withdrawn from the cylindrical portion 32.

When the conventional burner having the above construction is used in the horizontal attitude, as shown in FIG. 2, the temperature of the baffle 31 rises to from 700° to 1000° C., with a concomitant enlargement of the inner diameter of the cylindrical portion 32. At such time, the ceramic burner cone 30 undergoes less expansion than the cylindrical portion 32, so that a gap 40 forms between the cylindrical portion 32 and the burner cone 32, which thus tilts owing to the force of gravity. Accordingly, the burner cone 30 assumes an inclined attitude with respect to the central axis A–A′ of a swirler 33, thus producing a flame which also has an inclined attitude. A problem that results is uneven heating of heater tubes 34, shown in FIG. 1.

Another difficulty that arises when the burner cone 30 is inclined is that when the flame is extinguished at such time that the engine is shut off, the burner cone 30 may be damaged by stress applied thereto owing to contraction of the baffle 31, which cools at extinguishment of the flame. In addition, since the burner cone 30 is made of a ceramic and therefore has little electrical conductivity, the cone cannot serve as the ground electrode of the burner igniter. Though the swirler 33 has a metal flange 35 that is utilized as the ground electrode of the igniter in the prior art, the flame penetrates the interior of the swirler 33 since the spark produced by the igniter is close to the swirler. This can cause the swirler 33 to be burned.

DESCRIPTION OF THE PREFERRED EMBODIMENTS

Figure 3:
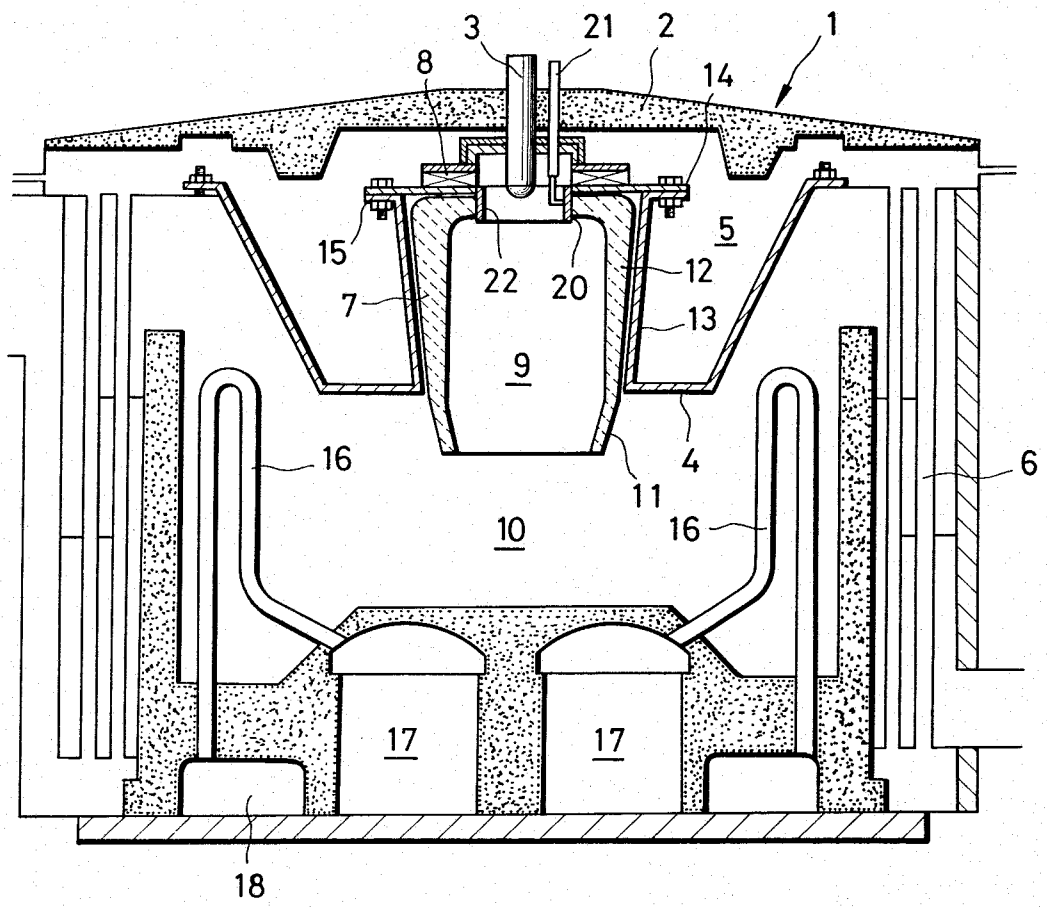
FIG. 3 is a schematic sectional view showing, in its entirety, a first embodiment of a burner for a Stirling engine according to the present invention.
Figure 4:
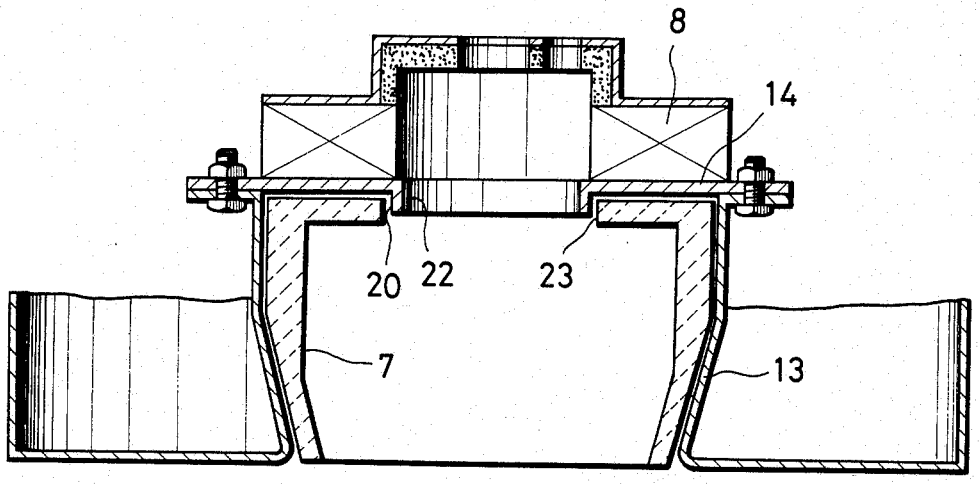
FIG. 4 is an enlarged sectional view illustrating a principal portion of the burner of FIG. 3.

The present invention is directed to solving the foregoing problems and will now be described in detail with reference to FIGS. 3 through 5.

A burner 1 for a Stirling engine has a top wall 2 provided with a fuel injection nozzle 3 for injecting fuel. A combustion air passageway 5 communicating with a combustion air preheater 6 is formed between the top wall 2 and a baffle 4, the outer circumferential portion of which is secured to the side of the burner body. Formed in the central portion of the baffle 4 is a tapered cylindrical portion 13 in which is inserted a burner cone 7 having a tapered outer circumferential surface 12 and comprising a heat-resistant ceramic of silicon nitride type. A swirler 8 is disposed at the upper portion of the burner cone 7 and surrounding the nozzle 3 and is bolted securely to a rim portion 15 of the partition wall 4 via a metal flange 14 of the swirler 8. The nozzle 3 points toward a primary combustion chamber 9 inside the burner cone 7, which opens to a main combustion chamber 10. Arranged in the main combustion chamber 10 are a plurality of radially arrayed and circumferentially spaced heater tubes 16 communicating at one end with a working space 17 of the Stirling engine and at the other end with a regenerator 18.

The metal flange 14 is provided with an engagement portion 22 having an annular outer circumferential surface 20. The engagement portion 22 is inserted into an inlet portion of the burner cone 7 on the upstream side thereof. An igniter 21 has an electrode rod situated in the proximity of the engagement portion 22.

In the operation of the burner 1 having the foregoing construction, combustion air from the combustion air passageway 5 is converted into a swirling air stream by the swirler 8 and then enters the inlet portion of the burner 7 on its upstream side. The fuel is injected into the inlet of the burner cone 7 from the fuel injection nozzle 3, mixes with the air and is ignited by a spark produced across the igniter 21 and the engagement portion 22, after which the air-fuel mixture enters the primary combustion chamber 9 for undergoing primary combustion.

This mixture is then supplied to the main combustion chamber 10. The swirling air stream introduced from into the burner cone 7 from the swirler 8 shortens the flame from the nozzle 3 and thus acts to produce a more uniform flame. It also promotes effective mixing of the air and the fuel in the primary combustion chamber 9 so that locally excessive concentrations of the mixture do not form. The burner cone 7 has a constricted outlet 11 which is effective for achieving complete combustion by uniformly and evenly distributing the swirling gas mixture, which has preliminarily combusted in the primary combustion chamber 9, in the main combustion chamber 10.

Owing to heat given off by the combustion of the fuel, the metal baffle 4 expands, as a result of which its cylindrical portion 13 increases in diameter. The ceramic burner cone 7 also expands, but to a lesser degree than the metal baffle 4. If the burner is used in a horizontal attitude, therefore, the burner cone 7 will attempt to move forwardly and to tilt with respect to the horizontal owing to the force of gravity acting upon it. At such time, however, the engagement portion 22 prevents tilting of the burner cone 7 since its annular outer circumferential surface 20 expands radially outwardly owing to the heat of combustion and engages an annular end face 23 (FIG. 4) of the burner cone 7 on its upstream side. Accordingly, the air-fuel mixture is fed into the primary combustion chamber 9 uniformly with respect to the central axis of the chamber and, moreover, is distributed uniformly inside the main combustion chamber 10 without assuming an inclined state, thereby enabling the mixture to be completely combusted. Accordingly, the heater tubes 16 can be heated uniformly so that the working gas inside the heater tubes 16 may be heated uniformly upon receiving the heat produced inside the main combustion chamber 10.

The burner cone 7 can be removed from the burner 1 in a simple manner merely by taking it out of the cylindrical portion 13 after the swirler 8 is detached.

According to the present invention as described above, the burner cone 7 is supported by the inner surface of the cylindrical portion 13 constituted by the baffle 4, and by the engagement portion 22. Therefore, the burner cone 7 will not tilt or be subjected to stress due to the influence of thermal expansion. Since the engagement portion 22 can be used as the ground terminal of the igniter 21, the position of the spark produced by the igniter is lower than in the prior art, so that ingition can be achieved more reliably. In addition, the flame produced can be prevented from entering the swirler 8. Furthermore, the burner cone 7 can be installed and removed very simply just as in the prior art, namely by inserting the burner cone 7 into and withdrawing it from the cylindrical portion 13.

Figure 5:
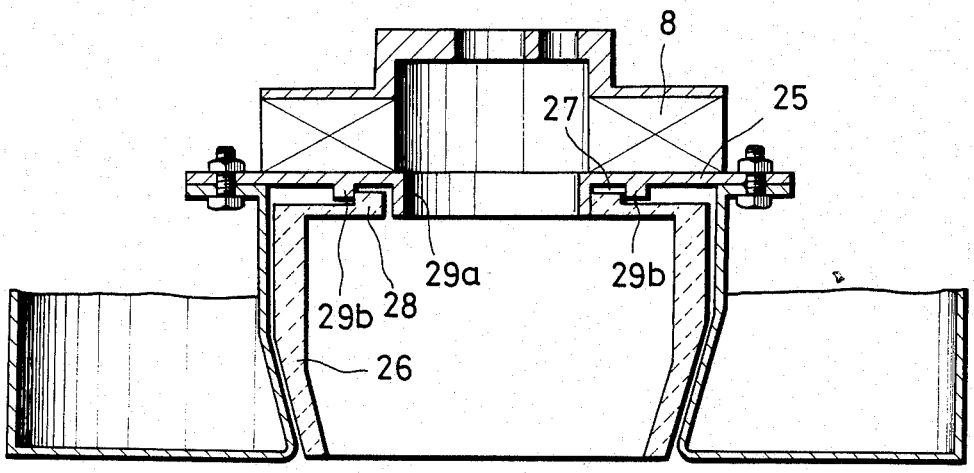
FIG. 5 is an enlarged sectional view illustrating a principal portion of second embodiment of a burner for a Stirling engine according to the present invention.

A second embodiment of a burner according to the present invention is illustrated in FIG. 5. This embodiment differs from the first embodiment solely in the shape of the metal flange, shown at numeral 25, of the swirler 8, and in the shape of the burner cone, indicated at numeral 26. Specifically, the metal flange 25 has an annular groove 27 defined between inner and outer rim portions **29*a* 29*b*, respectively, of the flange 25, and the inlet of the burner cone 26 on the upstream side thereof is provided with an annular projection 28. After the burner cone 26 has been installed, the swirler 8 is attached with the annular groove of the 27 of the metal flange 25 being mated with the annular projection 28 of the burner cone 26. Thus, the annular projection 28 is engaged by the rim portions 29*a*, 29*b*** in two directions perpendicular to the direction of the central axis. The actions and effects of this embodiment are similar to those of the first embodiment.

According to the present invention, the burner cone is reliably engaged by the engagement portion and therefore will not tilt when the burner is used in a horizontal attitude, even if a difference in thermal expansion develops between the baffle and the burner cone. This assures that the flame will not become inclined and, hence, that it will be uniform along the central axis of the burner cone to provide even heating of the heater tubes. Since the burner cone has a simple configuration, the cone is not subjected to local internal stress nor to stress applied from the outside. This assures that the burner cone will not be damaged even if there is a sudden change in the amount of combustion. A secondary advantage is that the igniter can be disposed at the inlet portion of the burner cone on its upstream side. This makes it possible for the spark to be produced at a position remote from the swirler so that the swirler will not be damaged by being burnt.

As many apparently widely different embodiments of the present invention can be made without departing from the spirit and scope thereof, it is to be understood that the invention is not limited to the specific embodiments thereof except as defined in the appended claims.

What is claimed is:

1. A burner for a Stirling engine, comprising:

a housing;

a baffle for partitioning the interior of said housing into an air chamber and a combustion chamber, said baffle having an outer circumferential portion supported on said housing and a centrally located cylindrical portion of tapered configuration;

a generally cylindrical ceramic burner cone for primary combustion of a mixture of fuel and combustion air, said burner cone being inserted into and retained by the cylindrical portion of said baffle and having a tapered outer circumferential surface and an annular end face on an upstream side thereof;

a plurality of heater tubes supported on said housing and arranged on an inner circumferential side of the combustion chamber; and a fuel injector nozzle supported on said housing for injecting fuel into said burner cone at an upstream portion thereof;

said baffle being equipped with an engagement portion having an annular outer circumferential surface for engaging the annular end face of said burner cone;

said burner cone being retained by the tapered cylindrical portion of said baffle and said engagement portion.

2. The burner according to claim 1, further comprising a swirler for introducing air, a portion of said swirler constituting part of an upstream end of the tapered cylindrical portion of said baffle, said engagement portion being provided on said swirler.

3. The burner according to claim 1, wherein said burner cone includes an annular projection which projects toward an upstream side, said annular projection having an inner circumferential surface serving as an engagement surface, and the engagement portion of said baffle has an annular groove provided concentrically with respect to said annular projection, said annular projection being fitted into and retained by said annular groove.

* * * * *